United States Patent [19]

Futamura

[11] Patent Number: 4,677,945

[45] Date of Patent: Jul. 7, 1987

[54] MECHANICAL VALVE LIFTER CONSTRUCTION ADAPTED FOR MECHANICAL/HYDRAULIC VALVE LIFTER INTERCHANGABILITY

[75] Inventor: Kazumasa Futamura, Toyota, Japan

[73] Assignee: Toyota Jidosha Kabushiki Kaisha, Japan

[21] Appl. No.: 780,431

[22] Filed: Sep. 26, 1985

[30] Foreign Application Priority Data

Jan. 18, 1985 [JP] Japan ..... 60-007065

[51] Int. Cl.[4] ..... F01L 1/14

[52] U.S. Cl. ..... 123/90.48; 123/90.33; 123/90.51

[58] Field of Search ..... 123/90.48, 90.51, 90.33, 123/90.35

[56] References Cited

U.S. PATENT DOCUMENTS

| | | | |
|---|---|---|---|
| 1,983,735 | 12/1934 | Corlett | 123/90.51 |
| 2,324,006 | 7/1943 | Lenz et al. | 123/90.48 |
| 2,682,863 | 7/1954 | Line | 123/90.48 |
| 2,749,891 | 6/1956 | Russell | 123/90.48 |
| 3,024,775 | 3/1962 | Wuest | 123/90.48 |
| 3,059,627 | 10/1962 | Dadd | 123/90.48 |
| 3,234,815 | 2/1966 | Line | 123/90.48 |
| 3,238,933 | 3/1966 | Humphreys | 123/90.48 |
| 4,317,433 | 3/1982 | Fuhrmann | 123/90.51 |

*Primary Examiner*—Ira S. Lazarus

*Attorney, Agent, or Firm*—Parkhurst & Oliff

[57] ABSTRACT

An engine is formed with a valve lifter bore with a lubricant supply opening, positioned at an axially intermediate point therealong, to which is communicated a passageway to which lubricating oil is supplied under pressure. This lubricant supply opening could be used together with a hydraulic type valve lifter. The engine also has a means (such as a cam shaft) for reciprocating a valve lifter in the valve lifter bore along a determinate stroke. The mechanical valve lifter construction of this invention includes a generally cup shaped valve lifter, with an outer cylindrical surface slidably inserted in the valve lifter bore and with an internal hollow, formed with a generally radially extending lubricant escape hole through its side from its internal hollow to its outer cylindrical surface. The lubricant escape hole opens to the outer cylindrical surface of the valve lifter at such a position that, when the valve lifter is slidably inserted in the valve lifter bore and is reciprocated therein by the reciprocating means, the lubricant escape hole does not come into register with the lubricant supply opening at any time during the movement of the valve lifter along its determinate stroke. Thereby, spurting out of the pressurized lubricating oil through the lubricant escape hole is positively prevented. This mechanical valve lifter construction thus can be applied to an engine cylinder block to which, alternatively, a hydraulic valve lifter construction can also be applied, and thus an economy in the number of parts required is effected.

3 Claims, 4 Drawing Figures

MECHANICAL VALVE LIFTER CONSTRUCTION ADAPTED FOR MECHANICAL/HYDRAULIC VALVE LIFTER INTERCHANGABILITY

BACKGROUND OF THE INVENTION

The present invention relates to the field of valve lifter constructions for internal combustion engine, and in particular to a mechanical type of valve lifter construction which can be used with an internal combustion engine which can also easily be adapted to utilize a hydraulic type of valve lifter construction.

In the prior art there are several known types of valve lifter construction for internal combustion engines. There is the mechanical type of valve lifter construction, in which a cam bears on valve lifter member which in turn pushes on a push rod, and in which excess play (so called lash adjustment) is taken up by mechanical adjustment as by the adjustment of a tappet screw fitted with a lock nut—and this type, which incorporates no system component utilizing oil pressure, is too well known to require illustration or further description herein. Alternatively, there is an oil pressure type of hydraulic valve lifter construction, which performs lash adjustment to a zero lash condition by supply of pressurized lubricating oil to an oil compartment thereof, to expand the size of said oil compartment. Such a type of per se conventional valve lifter construction is shown in FIG. 4 of the accompanying drawings in longitudinal cross section. This valve lifter construction, designated as 25 in the figure, is of the type shown and described in Japanese Utility Model Laying Open Publication Serial No. 57-160905 (1982). It comprises an outer casing 26 formed in the shape of a cylinder with a closed end or a cup shape, a lifter bore 12 within which said outer casing 26 reciprocates, a cam shaft 15 with a cam 16 for actuating said outer casing to reciprocate it, a plunger portion 27 and a plunger cap 28 which are fitted in the inside of said outer casing 26, a check valve ball 29, a check valve spring 30, and a plunger spring 31. The outer casing 26 is provided with a lubricating oil intake port 33 which, as said outer casing 26 reciprocates in said lifter bore 12, repeatedly comes into register with an opening 19*a* where a lubricating oil passageway 19 formed through the engine cylinder block assembly opens into said lifter bore 12 at an axially intermediate position therealong. The passageway 19 is continually supplied with lubricating oil at a high pressure value, and accordingly, every time the intake port 33 comes into register with the opening 19*a*, pressurized lubricating oil is admitted into an oil chamber 32 located within the valve lifter, thus to increase the length of the valve lifter construction as much as possible. This means that all excess play in the valve train is taken up by such increase of the length of the valve lifter construction; if further details of the operation of this hydraulic type valve lifter construction are required, reference should be made to the above identified Japanese Utility Model Laying Open Publication Serial No. 57-160905 (1982).

On the other hand, the valve lifter portion of a mechanical type valve lifter construction is typically formed in a cup shape, that is, as a hollow cylinder with a closed bottom and a cylindrical side wall portion rising therefrom to define an open top, with the lower or outer side of the closed bottom riding on the cam and with the lower end of the push rod seated against the upper or inner side of said closed bottom with said push rod protruding upwards out of said open end, and it is usual to form one or two radially extending holes through the cylindrical side wall portion of said valve lifter, for allowing oil that has flowed into the interior of the cup shape thereof to escape and to lubricate the contact portion between said outer side of said closed bottom and said cam. This oil escape hole is essential for thus supplying lubrication to said contact portion. Further, during the process of manufacture of such valve lifters, which is typically done by casting a plurality of them together, these radial holes are naturally defined by the matrix portion of the core for casting. Thus, in summary, such oil escape holes cannot be omitted from a mechanical valve lifter construction.

Now, in order to avoid the undue proliferation of different types of engine parts, and in view of the fact that it is desirable to be able to offer to the public both engines which utilize mechanical type valve lifter constructions and also engines which utilize hydraulic type valve lifter constructions, it would be very desirable, even in the case of utilization of a mechanical type valve lifter construction, for the same engine cylinder block assembly to be used, as was used in the case of a hydraulic type valve lifter construction. In other words, it would be desirable for only one type of cylinder block assembly to be fittable either with mechanical type valve lifter constructions or with hydraulic type valve lifter constructions, as required. This would mean that only one type of cylinder block assembly would need to be manufactured for both such types of engine, and the consequent advantages in terms of production convenience and also stocking economy are manifest.

The difficulty engendered by this, however, is as follows. As the mechanical valve lifter of the type outlined above moves up and down in a valve lifter bore adapted for use with a hydraulic type valve lifter, such as the bore 12 of the FIG. 4 construction in which pressurized oil is being supplied to a side opening such as the opening 19*a* at an axially intermediate position therealong, when the aforementioned radial oil escape hole comes into register with the side opening, then a considerable volume of oil will inevitably spurt from said side opening into the cup space within the valve lifter. And this creates the danger of a sharp drop in lubricating oil pressure in the lubricating system for the engine, which could be very troublesome.

SUMMARY OF THE INVENTION

Accordingly, it is the primary object of the present invention to provide a mechanical valve lifter construction which avoids the above outlined problems.

It is a further object of the present invention to provide such a mechanical valve lifter construction which is suitable for application to an engine to which also a hydraulic type of valve lifter construction can be applied.

It is a further object of the present invention to provide such a mechanical valve lifter construction in which, although the engine block is provided with an opening at an intermediate point in the valve lifter bore to which pressurized oil is supplied as for use with a hydraulic type of valve lifter, nevertheless such pressurized oil is not allowed to escape in great spurts.

It is a further object of the present invention to provide such a mechanical valve lifter construction which, while being applicable to an engine to which also a hydraulic type of valve lifter construction can be applied, does not create any problems thereby.

It is a further object of the present invention to provide such a mechanical valve lifter construction which maintains good lubricating oil pressure.

It is a further object of the present invention to provide such a mechanical valve lifter construction which does not provoke sudden drop of lubricating oil pressure.

It is a yet further object of the present invention to provide such a mechanical valve lifter construction which provides good lubrication for itself and for a cam with which it cooperates.

It is a yet further object of the present invention to provide such a mechanical valve lifter construction which is durable.

It is a yet further object of the present invention to provide such a mechanical valve lifter construction which is easy to fabricate.

It is a yet further object of the present invention to provide such a mechanical valve lifter construction which can effect economy of parts.

According to the most general aspect of the present invention, these and other objects are accomplished by a mechanical valve lifter construction, for an engine formed with a valve lifter bore with a lubricant supply opening, positioned at an axially intermediate point therealong, to which is communicated a passageway to which lubricating oil is supplied under pressure, said engine comprising means for reciprocating a valve lifter in said valve lifter bore along a determinate stroke, comprising: a generally cup shaped valve lifter, with an outer cylindrical surface slidably inserted in said valve lifter bore and with an internal hollow, formed with a generally radially extending lubricant escape hole through its side from its said internal hollow to its said outer cylindrical surface; said lubricant escape hole opening to said outer cylindrical surface of said valve lifter at such a position that, when said valve lifter is slidably inserted in said valve lifter bore and is reciprocated therein by said reciprocating means, said lubricant escape hole does not come into register with said lubricant supply opening at any time during the movement of said valve lifter along its said determinate stroke.

According to such a structure, since the lubricant escape hole does not come into register with the lubricant supply opening at any time during the normal operation of the engine, thereby spurting out of the pressurized lubricating oil in said lubricant passageway through said lubricant escape hole in large volume is positively prevented. Accordingly, this mechanical valve lifter construction does not provoke any sudden drop of lubricating oil pressure, and keeps engine lubricating oil pressure high at all times. Because it can tolerate the presence of the lubricant supply opening in the side of the valve lifter bore with pressurized lubricating oil being supplied thereto, without undergoing any problems, this mechanical valve lifter construction is suitable for application to an engine to which also a hydraulic type of valve lifter construction can be applied, and accordingly effects economy of parts. And because this valve lifter has a radially extending hole in its side, as explained above it is relatively easily fabricatable by a casting process.

Further, according to a more particular aspect of the present invention, these and other objects are more particularly and concretely accomplished by a mechanical valve lifter of the type described above, wherein said lubricant escape hole, at a certain point during the movement of said valve lifter along its said determinate stroke, comes at least partially out of said valve lifter bore in the longitudinal direction thereof towards said means for reciprocating said valve lifter.

According to such a structure, oil which has accumulated in said internal hollow of said valve lifter is allowed, when said lubricant escape hole has thus come at least partially out of said valve lifter bore towards said means for reciprocating said valve lifter, is allowed to pass through said lubricant escape hole to splash on said reciprocating means (such as a cam shaft) and on the bottom surface of said valve lifter which is cooperating therewith. Accordingly, this mechanical valve lifter construction provides good lubrication for itself and for the cam or other member or means with which it cooperates, and therefore is durable.

BRIEF DESCRIPTION OF THE DRAWINGS

The present invention will now be shown and described with reference to the preferred embodiment thereof, and with reference to the illustrative drawings. It should be clearly understood, however, that the description of the embodiment, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings, like parts and spaces and so on are denoted by like reference symbols in the various figures thereof; in the description, spatial terms are to be everywhere understood in terms of the relevant figure; and:

DESCRIPTION OF THE PREFERRED EMBODIMENT

Figure 1:
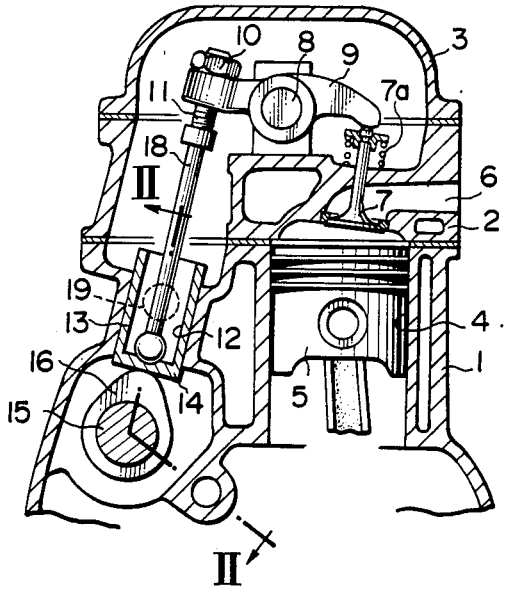
FIG. 1 is a transverse sectional view taken through an internal combustion engine equipped with multiple examples of the preferred embodiment of the valve lifter construction according to the present invention.

The present invention will now be described with reference to the preferred embodiment thereof, and with reference to the appended drawings. FIG. 1 is a transverse sectional view taken through an internal combustion engine equipped with multiple examples of the preferred embodiment of the valve lifter construction according to the present invention. In these figures, the reference numeral 1 denotes the cylinder block of the engine, while 2 is the cylinder head fitted on said cylinder block 1 with the interposition of a head gasket therebetween, and 3 is a cover for the top side of said cylinder head 2. The cylinder block 1 is formed with a plurality of cylinder bores 4, only one of which can be seen in FIG. 1, and a per se conventional piston 5 reciprocatingly slides in said bore 4, being mounted on one end of a connecting rod which is connected to a crankshaft and so on in a per se known fashion. In the cylinder head 2 there are formed a plurality of intake ports 6, one for each cylinder bore 4, and poppet type intake valves 7 equipped with corresponding intake valve springs 7*a* control the opening and closing of said intake ports 6. Similarly, exhaust ports whose opening and closing is controlled by poppet type exhaust valves which also have exhaust valve springs are provided for the cylinders 4, but these exhaust arrangements are not shown in the figures.

In the cylinder head 2, along an axis skew perpendicular to the axial lines of the cylinder bores 4 of the engine, there is fitted a rocker arm shaft 8. At longitudinal positions corresponding to each one of the intake valves 7 and each one of the exhaust valves (not shown) there is rotatably fitted on said rocker arm shaft 8 a rocker arm 9. One end (the right end in FIG. 1) of each of these rocker arms 9 bears on the end of one of the poppet valves of the engine, either an intake or an exhaust valve, and the other end of said rocker arm 9 is provided with an adjustment screw 11 to which is fitted a lock nut 10.

Figure 2:
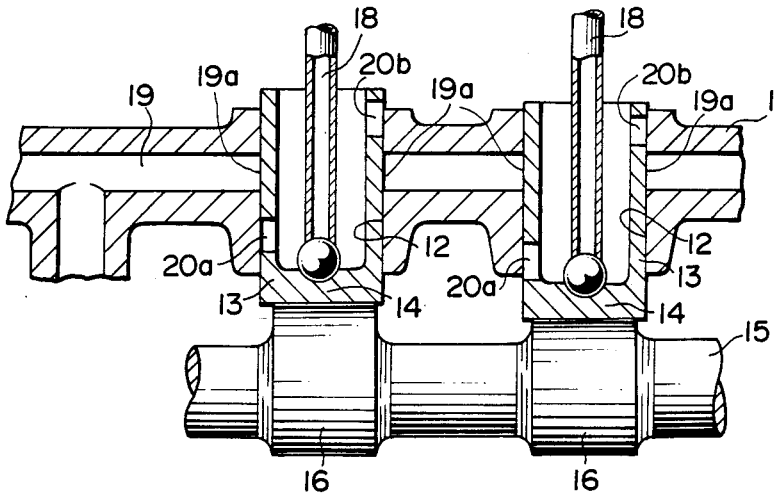
FIG. 2 is a transverse sectional view through several valve lifter bores of the FIG. 1 engine and through corresponding valve lifter members fitted in them, also showing a cam shaft of said engine.

In the cylinder block 1 there is integrally formed, for each of the rocker arms 9 and longitudinally corresponding thereto, a valve lifter bore 12. In each of these valve lifter bores 12 there is axially slidably fitted a generally cup shaped valve lifter member 13, which has a cylindrical outer surface, a cylindrical inner cavity, and a bottom portion 14, so that the cup shape of each said valve lifter member 13 opens in the upwards direction from the point of view of FIGS. 1 and 2. A transverse sectional view through several of said valve lifter bores 12 and through the corresponding valve lifter members 13 fitted in them is shown in FIG. 2. A cam shaft 15 of a per se known type is fitted in the cylinder block 1 below said valve lifter members 13 in the figures, parallel to the rocker arm shaft 8 and the engine crankshaft, and is rotated at half crankshaft speed as is per se conventional. This cam shaft 15 is formed with a plurality of cams 16, one for each valve lifter member 13, and the outer or lower side of bottom portion 14 of each of the valve lifter members 13 bears on the corresponding one of the cams 16. Further, for each valve lifter member 13, a push rod 18 is provided: the lower end portion of this push rod 18 sits in the cup shape of its valve lifter member 13 as bearing on the inner or top surface of the bottom portion 14 of said valve lifter member 13, within the cup shaped cavity thereof, while the upper end portion of this push rod 18 is seated on the adjustment screw 11 of the corresponding rocker arm 9. Thus, as the engine crankshaft turns, the cam shaft 15 and the cams 16 thereon turn, and this causes each of the valve lifter members 13 to be alternately raised and lowered in its bore 12 according to the particular shape of its cam 16, along a determinate stroke in said bore 12, and this reciprocating action, via the push rod 18 for this valve lifter member 13 which is kept in compression by the action of the valve spring corresponding thereto, pushes on the left end in FIG. 1 of the corresponding rocker arm 9 to raise and lower it, which in turn causes the right end in FIG. 1 of said rocker arm 9 to open and close the corresponding intake or exhaust valve by alternately pushing on it and releasing it.

Figure 4:
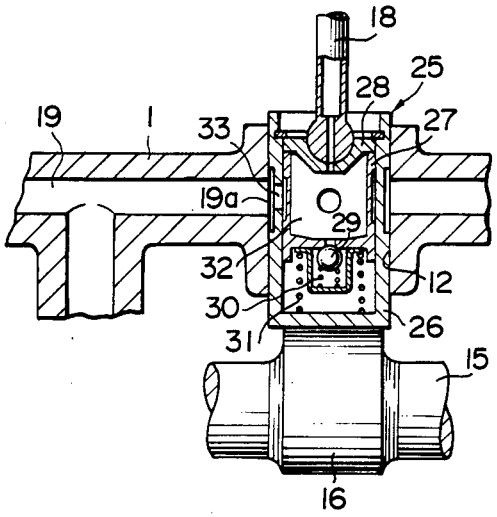
FIG. 4 PRIOR ART
FIG. 4 is a schematic sectional view, taken in a plane similar to FIG. 2, showing a per se known type of hydraulic valve lifter, as fitted to the same type of cylinder block as utilized in the engine of FIGS. 1 and 2.

Now, these valve lifter assemblies described above are of the mechanical type, and, when the lash therein is required to be adjusted, this is performed by adjusting the adjustment screws 11 and by fixing them by the nuts 10. However, various of the parts of the internal combustion engine which are shown, and in particular the cylinder block 1, are also intended for use in engines utilizing per se known hydraulic type valve lifters such as described above in the section of this specification entitled "Background of the Invention" and illustrated in FIG. 4. According to this alternative use, the cylinder block 1 is formed with a lubricating oil passageway 19 which intersects each of the bores 12 of the valve lifter members 13 at openings 19*a* into their cylindrical inner surfaces. And, during operation of the engine, this passageway 19 is supplied with lubricating oil under pressure from a pressure pump means not shown in the figures. Such a lubricating oil passageway 19 with pressurized lubricating oil supplied thereto is necessary for use of the cylinder block with hydraulic type valve lifters, as previously explained.

Figure 3:
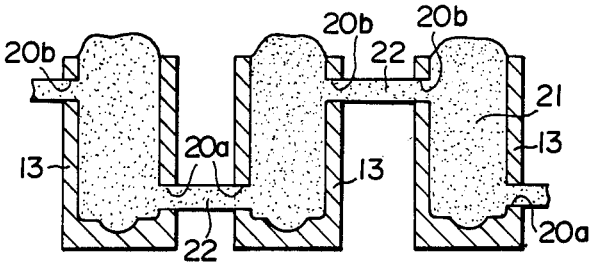
FIG. 3 is a schematic sectional view showing the process of manufacturing several of the valve lifter members of FIGS. 1 and 2 together by casting.

Now, through the cylindrical side walls of the valve lifter members 13 there are pierced radially extending openings 20*a* and 20*b*: the openings 20*a* are near the lower ends in FIGS. 1 and 2 of the valve lifter members 13, in other words are near their bottom portions 14, while the other openings 20*b* are near the upper ends in FIGS. 1 and 2 of the valve lifter members 13, in other words are near their open upper end portions. As shown in FIG. 3, during the process of fabricating the valve lifter members 13 by casting a plurality of them together, these openings 20*a* and 20*b* through their cylindrical side walls are caused to be formed by the core matrix portions 22 of the interlinked cores 21, and the positions of said openings 20*a* and 20*b* are determined by the established positions of said core matrix portions 22. And, as explained previously, it is not economically practicable to manufacture the valve lifter members 13 without some such openings being formed through their cylindrical side wall surfaces at some points thereon.

Particularly according to the concept of the present invention, these through openings 20*a* and 20*b* are located at positions on said cylindrical side walls of the valve lifter members 13 which at no time, during the normal operation of the engine with the valve lifter members 13 reciprocating in their bores 12 from the one ends of their normal strokes to the other ends thereof, correspond to or come into register with the openings 19*a* at which the lubricating oil passageway 19 intersects the bores 12. Accordingly, at no time during the normal operation of the engine is the pressurized lubricating oil supplied to the passageway 19 vented in a large amount through the openings 19*a* and through any of the openings 20*a* or 20*b*. Thus, sudden dropping of the oil pressure of the engine is prevented, and this is ensured while providing the lubricating oil passageway 19 in the cylinder block 1 in the same location as in the case of an engine which has hydraulic type valve lifters of the type shown in FIG. 4 and discussed above.

In the shown preferred embodiment, in fact, the lower ones 20*a* of the openings 20 through the cylindrical side walls of the valve lifter members 13 are communicated to the space below the bores 12, when said valve lifter members 13 are at the bottom ends of their strokes in said bores 12, as exemplarily shown in FIG. 2 by the right hand one of the illustrated valve lifter members 13; and, correspondingly and conversely, the upper ones 20*b* of the openings 20 through the cylindrical side walls of the valve lifter members 13 are communicated to the space above the bores 12, when said valve lifter members 13 are at the top ends of their strokes in said bores 12, as exemplarily shown in FIG. 2 by the left hand one of the illustrated valve lifter members 13. Accordingly, with regard to each of the lower openings 20*a*, when it thus comes out of its bore 12 at its lower end, lubricating oil which has accumulated in the cup shape of the corresponding valve lifter member 13 is allowed to flow out and to splash on the meeting surface between the corresponding cam 16 and the bottom wall portion 14 of said valve lifter member 13, thus providing good and definite lubrication for said cam 16 and said bottom wall portion 14. Accordingly, good durability for the cam shaft 15 and its cams 16, and for the engine as a whole, is promoted.

Thus it is seen that, by appropriately configuring the core matrix portions 22 of the interlinked cores 21 during the process of manufacturing the valve lifter members 13 by casting, the openings 20*a* and 20*b* through their cylindrical side walls, the positions of which are determined by the positions of said core matrix portions 22, are caused to be located at positions which at no time during the normal operation of the engine correspond to or come into register with the openings 19*a* at which the lubricating oil passageway 19 intersects the bores 12. Thereby, no problem is caused of sudden loss of lubricating oil pressure, even although the passageway 19 is provided in the same way and in the same place as in the case of an engine which is equipped with hydraulic type valve lifters, and accordingly the same part (the engine block 1) can be utilized, both for such an engine equipped with hydraulic type valve lifters, and also for an engine equipped with mechanical type valve lifters. According, interchangability of parts is promoted, and accordingly manufacturing efficiency is enhanced, which brings attendant manufacturing cost reductions.

Although the present invention has been shown and described with reference to the preferred embodiment thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown preferred embodiment, or of the drawings, but solely by the scope of the appended claims, which follow.

What is claimed is:

1. A mechanical valve lifter construction, for an engine formed with a valve lifter bore with a lubricant supply opening, positioned at an axially intermediate point therealong, to which is communicated a passageway to which lubricating oil is supplied under pressure, said engine comprising means for reciprocating a valve lifter in said valve lifter bore along a determinate stroke, comprising:

a generally cup shaped valve lifter, with an outer cylindrical surface slidably inserted in said valve lifter bore and with an internal hollow, formed with a generally radially extending lubricant escape hole through its side from its said internal hollow to its said outer cylindrical surface;

said lubricant escape hole opening to said outer cylindrical surface of said valve lifter at such a position that, when said valve lifter is slidably inserted in said valve lifter bore and is reciprocated therein by said reciprocating means, said lubricant escape hole does not come into register with said lubricant supply opening at any time during the movement of said valve lifter along its said determinate stroke.

2. A mechanical valve lifter according to claim 1, wherein said lubricant escape hole, at a certain point during the movement of said valve lifter along its said determinate stroke, comes at least partially out of said valve lifter bore in the longitudinal direction thereof towards said means for reciprocating said valve lifter.

3. A mechanical valve lifter according to claim 1, wherein said lubricant escape hole, at a certain point during the movement of said valve lifter along its said determinate stroke, comes at least partially out of said valve lifter bore in the longitudinal direction thereof away from said means for reciprocating said valve lifter.

* * * * *